United States Patent [19]

Naum

[11] Patent Number: 4,992,695

[45] Date of Patent: Feb. 12, 1991

[54] REFLECTOR FOR HIGH-INTENSITY LAMPS

[76] Inventor: Daniel Naum, 2048 Midvale Dr., San Diego, Calif. 92105

[21] Appl. No.: 418,872

[22] Filed: Oct. 10, 1989

[51] Int. Cl.[5] ..... H01J 5/16

[52] U.S. Cl. ..... 313/113; 313/114; 362/297; 362/346

[58] Field of Search ..... 313/113, 114, 110; 362/296, 297, 346, 347, 350

[56] References Cited

U.S. PATENT DOCUMENTS 2,799,791 7/1957 Honing et al. ..... 313/113 X

*Primary Examiner*—Kenneth Wieder

*Attorney, Agent, or Firm*—Ralph S. Branscomb

[57] ABSTRACT

A parabolic reflector differs from a standard paraboloid configuration by defining a relatively small, reflective cone on its reflective surface which is axially aligned with the longitudinal axis of the parabolic reflector. The reflective surface of the cone in any cross section taken through the conical axis and is so contoured that light impinging from a light source disposed forwardly of the reflector on the longitudinal axis thereof will strike the concave reflective surface of the cone, and reflect against the main parabolic reflecting dish, where it is re-reflected forwardly and parallel, thus eliminating the light from the lamp passing close to the longitudinal axis which would otherwise reflect back through the lamp rather than alongside it. This reflector is designed for use with high power HMI lamps from 1200 to 18 kw which are used for motion picture and television set lighting. Cone angle is from 15 degrees to 45 degrees maximum.

10 Claims, 1 Drawing Sheet

REFLECTOR FOR HIGH-INTENSITY LAMPS

BACKGROUND OF THE INVENTION

The invention is in the field of high intensity HMI lamps such as the kind used in movie sets and television lighting and in a number of other applications. Typically, these lamps are arc lamps in which the electrodes are surrounded by Argone gas at low pressure and a combination of mercury and rare earth elements. The temperature inside the lamps gets extremely high, and the light produced is quite intense, approximating the spectrum of sunlight. Bright colors are brought out very well by the lamp because of its high intensity and spectral distribution.

Because the lamps are so intense and run so hot, there life span is somewhat limited. The tungsten which is used in the electrodes evaporates and slowly coats the interior surface of the enclosing glass envelope, which further increases the heat by absorbing and reflecting the light rather than letting it pass through the glass. Thus as the lamp gets older, its deterioration accelerates.

Because in virtually all applications the light from this median point source lamp is required to be directed in a single beam of collimated or converging light, these lamps virtually always have a rear reflector so that rearwardly directed light is not lost. Reflectors in current practice are simple spherical mirror having its center of curvature at the lamp point-source. This arrangement, in a geometrically perfect model, reflects most of the rearwardly directed light back approximately along its incident path, so that it passes back through the point-source again in the forward direction. All reflectors in use are spherical. The trouble with this is that the light that is so reflected has already escaped the quartz envelope of the lamp once, but by being so reflected, the light passes again across the quartz envelope barrier once into the lamp and once again back out of the lamp at its forward side. Reflecting the light along this path needlessly further heats the lamp, and dissipates further the radiation which is needed forwardly in the lamp.

In another system which substantially avoids the above stated problem the generally hemispherical reflector has axial aperture and the lamp, which has two lateral arms, is oriented with its transverse axis, through the lateral arms, coincident with the axis of symmetry of the reflector. One arm of the lamp passes back through the axial hole in the reflector, and the result is that none of the light, or substantially none of the light, is redirected through the light source portion of the lamp.

However, this arrangement suffers from another drawback. The lamp must be mounted and suspended by the ends of its lateral arms, and thus, although not shown in drawings, the yolk and electrical connection to the ends of the arms interferes with light passage near the forwardly-directed arm. Thus although the reflected light successfully circumradiates the intense center of the lamp, nonetheless it loses a portion of its radiation by absorption and scattering off of the front portion of the mounting and energizing yolk. Even beyond this, in many applications it is desirable and perhaps an absolute necessity to mount the lamp in a transverse arrangement rather than a longitudinally aligned with the reflector axis.

There is a need therefore for a reflector arrangement that can accommodate a transversely extended high intensity lamp, having its transverse axis substantially perpendicular to the reflector axis, and yet reflect the rearwardly directed radiation from the lamp back forwardly in such a way that it passes by the lamp rather than re-penetrating the fiery core of the quartz envelope.

SUMMARY OF THE INVENTION

The instant invention fulfills the above stated need and provides in effect a parabolic reflector, which reflects the light substantially forwardly as a collimated beam, and could clearly be modified to converge the light. The axial center portion of the parabolic reflector would ordinarily re-direct the light directly across the light source, but its center is covered with a small cone having a concave outer reflective surface which redirects the light from the point-source against outer portions of the main parabolic reflector, where it is forwardly directed in a parallel fashion along with the light that is directly reflected off the main paraboloid, thus totally avoiding the double-passage of radiation through the lamp center.

DETAILED DESCRIPTION OF THE PREFERRED EMBODIMENT

Figure 5:
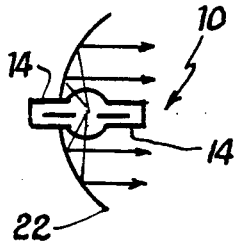
FIG. 5 is a diagrammatic illustration of one example of the prior art.
Figure 1:
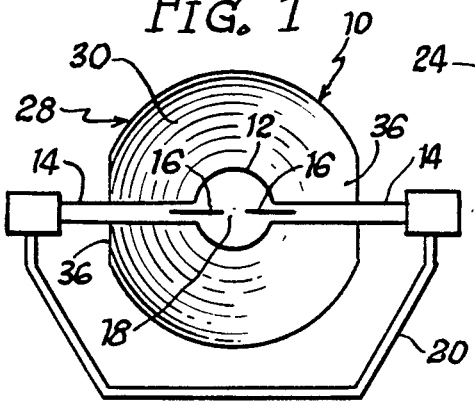
PRIOR ART FIG. 1
FIG. 1 is a diagrammatic front elevation view of the invention.

At the heart of the invention is a high intensity lamp 10. This lamp generally has a quartz envelope with a bulb 12 in its central region and laterally extending arms 14 which house the electrodes 16, between which passes an arc creating a very intense, hot light that approximates a point-source at 18, the center of the bulb envelope. The ends of the lamp are supported and powered by a yolk 20.

Figure 6:
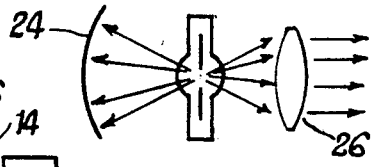
FIG. 6 is another example of the prior art.

The prior arrangements of the reflector and the lamp are shown in FIGS. 5 and 6. In FIG. 5, the lateral arms 14 which define a lateral axis are aligned with the reflector so that the lateral axis of the lamp coincides with the longitudinal axis of the reflector. The reflector, indicated at 22 in FIG. 5, is a spheroid, or something close to it, which produces slightly convergent forward radiation. Although the yolk is not shown, it is obvious that the yolk when connected to the forward arm will interfere with the passage of the light, both the direct light and the reflected light.

FIG. 6 illustrates an arrangement with transverse lateral arms relative to the reflector axis. In this embodiment, the spheroid reflector 24 re-directs light rays precisely along the paths of their incidence in an idealized model, as indicated in the figure. These rays then join the forwardly directed rays emitted from the lamp, exiting the lamp in a diverging mode which is corrected by a forward lens 26, which further absorbs light and reduces lamp efficiency. The arrangement in FIG. 6 is simple, but is also of a relatively low efficiency and contributes to rapid lamp burnout.

Figure 2:
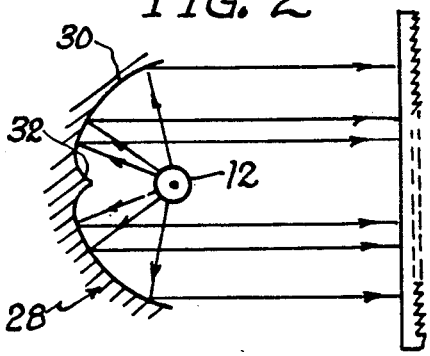
FIG. 2 is a vertical axial section of the invention.
Figure 3:
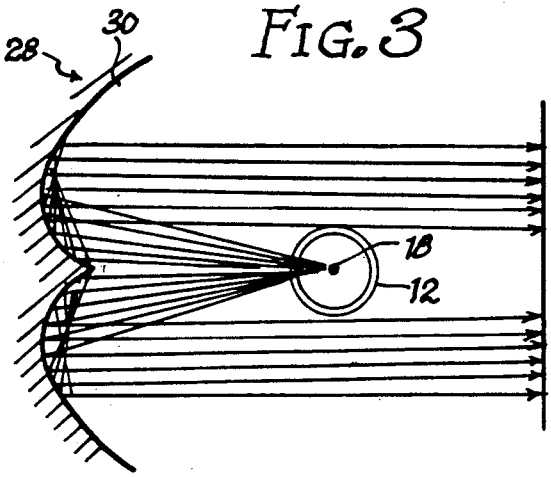
FIG. 3 is a ray diagram illustrating the light paths as modified by the axial cone.

The arrangement of the invention is illustrated in FIGS. 1–4. The reflector is illustrated at 28, and includes a parabaloid portion 30, which directs rearward radiation in a parallel forward direction as best illustrated in FIG. 2. The concave silver interior of the main parabaloid dish 30 is effective in efficiently re-directing rearwardly directed rays in its peripheral areas, but at its axial center, light would be redirected through the core of the lamp were it not for the small central reflective cone 32 which is coaxial with the main parabaloid 30. The exterior surface of this cone is highly reflective and is concave in all axial cross sections so that it reflects light from the lamp against the main reflector 30, from which it is redirected in a forward direction as best shown in FIG. 3.

The exact shape of the exterior surface of the cone obviously must be coupled exactly with the contour of the main parabaloid at the point at which incident rays would reflect so that any ray coming from the geometrical center of the approximately point light source which impinges upon the reflective surface of the cone will be accurately re-reflected by the main reflector 30 into a forwardly directed parallel vector.

Figure 4:
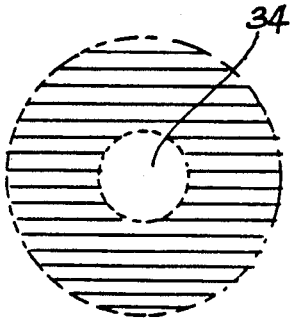
FIG. 4 illustrates the light pattern forward of the lamp.

The light pattern that this produces is shown in FIG. 4. Obviously, a slight modification could be made so that light converges at a certain point, to eliminate the central shadow 34. Alternatively, a lens such as lens 26 could be used in front of the lamp. Clearly, once columnar radiation has been achieved, anything can be done to produce whatever converging or diverging radiation pattern is desired.

As can be seen in FIG. 2, the perimeter of the mirror is circular with the exception of the cut-away portions 36, which accommodate the outwardly extended arms of the lamp. The circle of the perimeter defines a plane which bisects, or comes close to bisecting, the lamp. To produce a smooth and continuous reflective surface, the main reflector 30 and the cone 32 can be silvered together.

Figure 8:
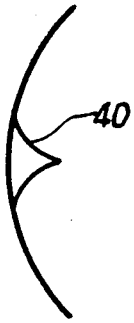
PRIOR ART FIG. 8
FIG. 8 is a diametric sectional view of a reflector similar to that of FIG. 7 but having a concave center cone.
Figure 7:
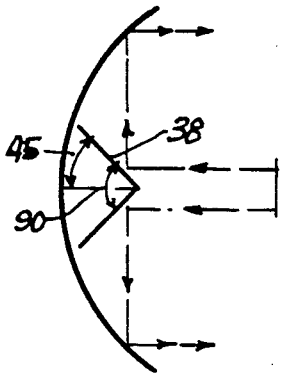
FIG. 7 is a diametric sectional view of an implementation of the invention using a separately-made conical reflector cone bonded to the main reflector.

FIG. 7 illustrates a cone 38, having a vertex angle of 90 degrees as indicated at 90, and a half-angle of 45 degrees as indicated at 45. This cone could be bonded to a semi-circular reflector as shown to achieve approximately the effect of the configuration shown in FIGS. 1–4. FIG. 8 is a similar embodiment in which the central cone 40 is concave-sided rather than being straight-sided as shown in FIG. 7.

Thus, the invention permits the lateral orientation of the high intensity lamp relative to the reflector, while eliminating the overheating and low efficiency of present mounting and reflective configurations, so that the best of all worlds is achieved.

I claim:

1. A reflector for concentrating the beam of a high-intensity lamp which minimizes the amount of light which is reflected back through the lamp itself, said reflector comprising:

(a) a main reflector dish having a reflective concave side, said concave side being contoured to reflect light from a substantially point source disposed in front of said concave side forwardly substantially parallel form; and, (b) a reflective cone disposed on said concave side positioned to be just behind a substantially point light source and contoured to reflect light from said source against said main dish at such an angle of incidence that light so reflected will be re-reflected forwardly from said main dish in substantially parallel form, whereby rearwardly directed light from said point source which would pass back through the lamp at said cone is instead re-directed around said lamp.

2. Structure according to claim 1 wherein said main dish is parabolic.

3. Structure according to claim 2 wherein the reflective concave side of said main dish is a parabaloid.

4. Structure according to claim 3 wherein said main dish exhibits axial symmetry, and the axis thereof passes substantially centrally through the axis of said cone and said substantially point source of light.

5. Structure according to claim 4 wherein said cone exhibits an axial symmetry and is coaxial with said dish.

6. Structure according to claim 5 wherein said cone has a 90 degree outer reflective surface in axial cross-section.

7. Structure according to claim 1 wherein said reflector is mounted together with a high intensity lamp, and the forward edge of said reflector substantially defines a circle having its center substantially coincident with the center of said lamp.

8. Structure according to claim 7 wherein said reflector is axial symmetrical about a longitudinal axis, and said lamp comprises a central light source enclosed in an envelope defining a pair of oppositely directed laterally extending arms which define a transverse axis, and said transverse axis is perpendicular to the longitudinal axis of said reflector.

9. Structure according to claim 8 wherein said reflector is cut away at opposite peripheral regions to accommodate a said arms.

10. Structure according to claim 1 wherein said cone and main dish are integral and define an integrally silvered unit.

* * * * *